United States Patent [19]

Hada et al.

[11] 3,967,157

[45] June 29, 1976

[54] DRIVING CIRCUIT FOR A GAS DISCHARGE DISPLAY PANEL

[75] Inventors: Hiroshi Hada; Tsutomu Hirayama; Kazunori Nishida, all of Tokyo, Japan

[73] Assignee: Nippon Electric Company, Ltd., Tokyo, Japan

[22] Filed: Jan. 20, 1975

[21] Appl. No.: 542,559

[30] Foreign Application Priority Data

Feb. 7, 1974 Japan ..... 49-15744

[52] U.S. Cl. ..... 315/169 TV; 313/201; 313/210; 313/217

[51] Int. Cl.[2] ..... H01J 1/53; H01J 11/04; H05B 37/00

[58] Field of Search ..... 315/169 R, 169 TV; 313/188, 201, 210, 217; 340/166 R, 166 EL, 324 M

[56] References Cited

UNITED STATES PATENTS

| | | | |
|---|---|---|---|
| 3,803,440 | 4/1974 | Andoh et al. | 313/188 X |
| 3,803,450 | 4/1974 | Trogdon | 315/169 TV |
| 3,840,779 | 10/1974 | Schermerhorn | 315/169 R |
| 3,851,212 | 11/1974 | Umeda et al. | 315/169 TV |

*Primary Examiner*—Siegfried H. Grimm
*Attorney, Agent, or Firm*—Hopgood, Calimafde, Kalil, Blaustein & Lieberman

[57] ABSTRACT

A circuit for driving one electrode group of a gas discharge display panel includes a plurality of PNP transistors and NPN transistors. The emitter electrodes of the PNP transistors are connected to a positive voltage source and the emitter electrodes of the NPN transistors are connected to ground. Diode means are connected between the collector electrodes of the PNP transistors and those of the NPN transistors across matrix points formed at the intersections of a first plurality of conductors connected respectively to the collector electrodes of the PNP transistors and a second plurality of conductors connected respectively to the collector electrodes of the NPN transistors. The individual electrodes of the one electrode group of the gas discharge tube are connected to the diode means and grounded through capacitors, which may be included in the gas discharge display panel.

9 Claims, 5 Drawing Figures

DRIVING CIRCUIT FOR A GAS DISCHARGE DISPLAY PANEL

BACKGROUND OF THE INVENTION

This invention relates to a circuit for driving a gas discharge display panel which may be an external electrode gas discharge display panel known in general as a plasma display panel.

A gas discharge display panel comprises a pair of opposed electrode groups arranged on either side of a gas discharge space means which may either be a continuous space filled with an ionizable gas of a plurality of like spaces, called discharge cells. Layers of an electrically insulating material may be provided on the opposed surfaces of the electrodes as in a plasma display panel. The electrode groups may either be groups of so-called matrix electrodes or a combination of a first group of segmented electrodes and a second group of the opposite electrode or electrodes.

A conventional driving circuit of the type described, includes at least one switching transistor for each of the electrodes of the display panel. The switching transistors must withstand a relatively high voltage, such as 140 volts. Also, a logic circuit has been necessary in order to supply pulses to each switching transistor. It has therefore been unavoidable that the circuit becomes bulky and expensive particularly when the panel to be driven has a great number, such as two hundred or more electrodes in at least one of the electrode groups. With a conventional driving circuit of the type described above, it has been necessary to compromise between the power consumption in the circuit and the speed at which the switching transistors turn off. This compromise has imposed a serious restriction on the progress of the art of plasma display panels and has made it impossible to utilize a so-called time division drive to activate a plasma display panel having segmented electrodes for a large number of digits, such as ten or more digits.

SUMMARY OF THE INVENTION

It is therefore an object of the present invention to provide a circuit having a relatively small number of switching transistors for driving one electrode group of a gas discharge display panel.

It is another object of this invention to provide a driving circuit of the type described, which is operable with a small number of logic circuits.

It is still another object of this invention to provide a driving circuit of the type described, operable at a high speed.

A circuit according to this invention for driving one electrode group of a gas discharge display panel having a pair of electrode groups arranged on opposed sides of gas discharge space includes a positive voltage source, a first plurality of PNP transistors, a second plurality of NPN transistors, and first means for connecting the emitter electrodes of the PNP transistors to the positive voltage source and second means for connecting the emitter electrodes of the NPN transistors to a reference potential. A first plurality of conductors are connected to the collector electrodes of the PNP transistors. A second plurality of conductors, are connected to the collector electrodes of the NPN transistors. Each of the second plurality of conductors provide a plurality of matrix points, intersects all of the first plurality of conductors to. At each of the matrix points, forwardly directed diode means are connected between the first and second conductors. Each electrode of the above-mentioned one group is to be connected to the diode means. The circuit further includes a capacitor connected between the diode means and a point of a constant voltage at each of the matrix points.

With a driving circuit according to this invention, one electrode group of a gas discharge display panel may be driven either in a time division fashion or selectively in compliance with the desired display. A similar circuit may be used to drive the other electrode group of the display panel.

DESCRIPTION OF THE PREFERRED EMBODIMENTS

Figure 1:
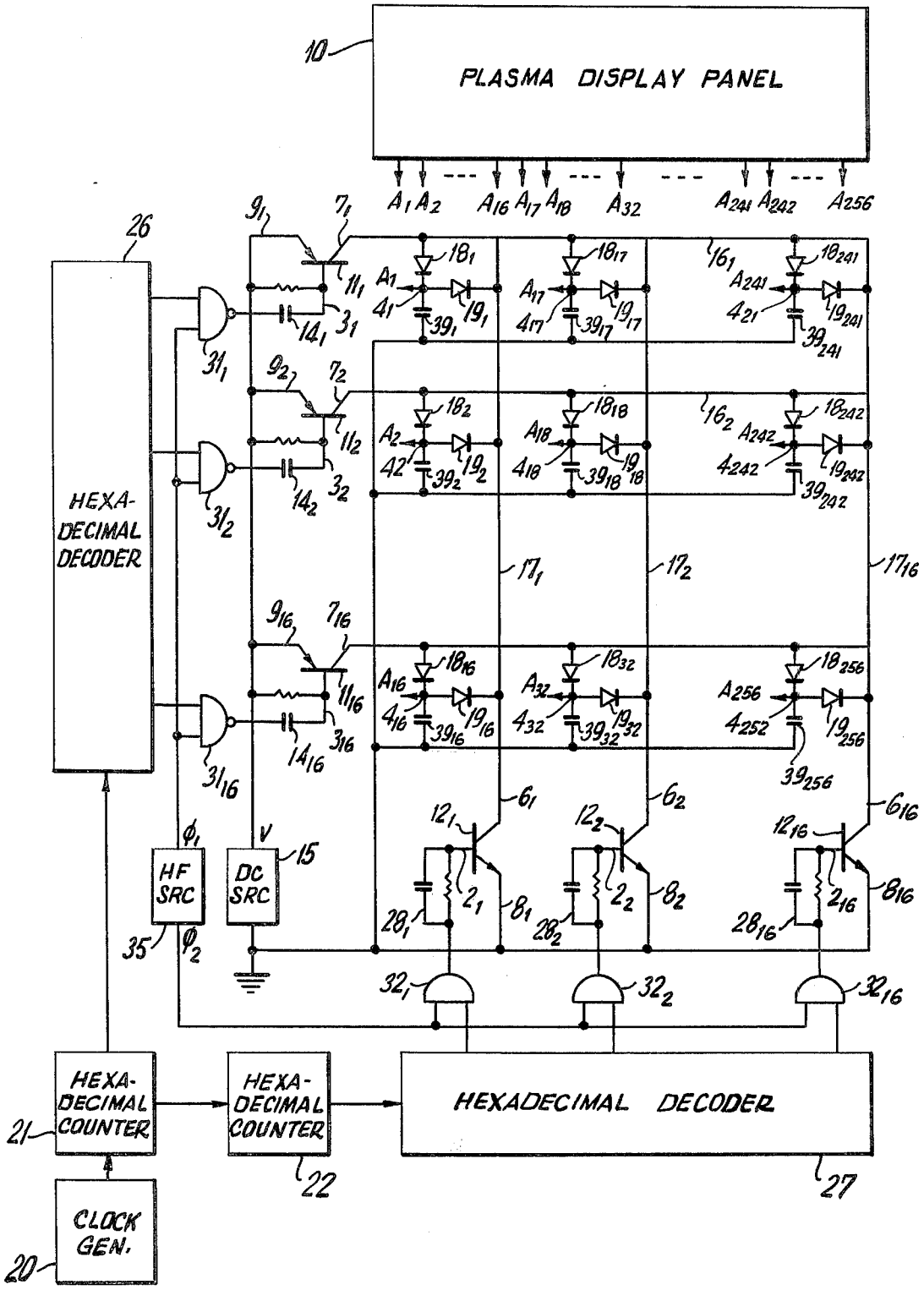
FIG. 1 shows, partly by block diagram, a driving circuit according to a first embodiment of the instant invention.

Referring to FIG. 1, a circuit according to a first embodiment of the present invention is shown which circuit is used for driving one electrode group, comprising 256 electrodes, of a plasma display panel show as block 10. This plasma display panel includes two electrode groups which are arranged on opposite sides of a gas discharge space as described in the preamble of the instant specification and shown in FIG. 4. The circuit of FIG. 1 comprises sixteen PNP transistors $11_1$, $11_2$, . . . , and $11_{16}$ and sixteen NPN transistors $12_1$, $12_2$, . . . , and $12_{16}$. For convenience of description, the suffixes of series of elements will be omitted hereinafter when the reference numeral or numerals refer to a relevant element or to elements in general rather than to specific one or ones thereof. The emitter electrodes $9_1$, $9_2$ . . . $9_{16}$ of the PNP transistors 11 are each connected to a source 15 of a positive voltage V which voltage is at least equal to the firing voltage of the gas discharge space. The emitter electrodes $8_1$, $8_2$ . . . $8_{16}$ of the NPN transistors 12 are grounded. Sixteen first conductors $16_1$, $16_2$ . . . $16_{16}$ are connected to the collector electrodes $7_1$, $7_2$ . . . $7_{16}$ of the respective PNP transistors 11. Sixteen second conductors $17_1$, $17_2$ . . . $7_{16}$ are connected to the collector electrodes $6_1$, $6_2$ . . . $6_{16}$ of the respective NPN transistors 12. Although the first conductors 16 are illustrated parallel to one another while the second conductors 17 are depicted perpendicular to the first conductors 16, it is only necessary that each of the second conductors $17_1$, $17_2$ . . . $17_{16}$ provide sixteen matrix points in cooperation with the first conductors $16_1$, $16_2$ . . . $16_{16}$. The first and second conductors 16 and 17 will thus form a total of 256 matrix points. At each of the matrix points series-connected diodes 18 and 19 are connected between the first and second conductors 16 and 17 as is shown in FIG. 1. The diodes 18 and 19 are forwardly directed. The junction points $4_1 \ldots 4_{256}$, of the diodes 18 and 19 which are 256 in total, are connected to the electrodes of one of the electrode groups of the plasma display panel through wirings $A_1, A_2 \ldots A_{256}$. If desired a resistor such as $4_1, 4_2 \ldots 4_{256}$ as shown in FIG. 5 may be substituted for one of the diodes 18 or 19 of FIG. 1. FIG. 5 shows an embodiment of the driving circuit utilizing resistors 4 to replace diodes 19 which embodiment operates substantially as described below with reference to FIG. 1.

In order to drive the electrodes of the display panel in a time division fashion, the circuit shown in FIG. 1 further includes a clock generator 20 which generates clock pulses at a repetition frequency which will later be discussed. The clock pulses are supplied to a first hexadecimal counter 21, whose frequency-divided output signal is supplied to a second hexadecimal counter 22. In the manner known in the art, a hexadecimal counter consists of four stages. Four-bit signals derived from the respective stages of the first hexadecimal counter 21 are supplied to a first hexadecimal decoder 26. Similar signals are supplied from the second hexadecimal counter 22 to a second hexadecimal decoder 27. Each hexadecimal decoder 26 or 27 successively energizes its sixteen output terminals. The circuit also includes sixteen NAND gates $31_1, 31_2 \ldots 31_{16}$. Each NAND gate 31 has one input which is connected to the respective output terminals of decoder 26 and is enabled by the signals supplied from the respective output terminals of the decoder 26. Similarly, sixteen AND gates $32_1, 32_2 \ldots 32_{16}$ have one of their input terminals connected to the respective output terminals of the second hexadecimal decoder 27 and are enabled by the signals derived at the respective output terminals of the second hexadecimal decoder 27. A pulse signal source 35 supplies a pair of two-phase pulse trains $\phi_1$ and $\phi_2$ to the second input terminals of the NAND gates 31 and the AND gates 32 respectively. The output terminals of the NAND gates 31 are connected to the base electrodes of the PNP transistors 11 through capacitors $14_1, 14_2 \ldots 14_{16}$. The output terminals of the AND gates 32 are likewise connected to the base electrodes $2_1, 2_2 \ldots 2_{16}$ of the NPN transistors 12 through RC circuits $28_1, 28_2 \ldots 28_{16}$. The circuit further includes capacitors $39_1 \ldots 39_{256}$ connected between the respective wirings A and a point of a substantially constant voltage, such as ground.

In operation, it is presumed for simplicity of description that use is not made of the capacitors 39. It is surmised in addition that the output terminals of the hexadecimal decoders 26 and 27 are energized. The two-phase pulse trains $\phi_1$ and $\phi_2$ turn the first PNP and NPN transistors $11_1$ and $12_1$ on alternatingly through NAND gate 31, and gate 32, respectively. The first wiring $A_1$ will therefore be supplied with a pulse voltage which rises approximately to the positive voltage V at every leading edge of each pulse in the first pulse train $\phi_1$ and returns approximately to ground at every leading edge of each pulse in the second pulse train $\phi_2$. The second through sixteenth wirings $A_2$ through $A_{16}$ are kept substantially at ground during this period because the points of connection of the diodes 19 to the second conductor 17 are grounded when the NPN transistor $12_1$ is conducting and because the diodes 19 will prevent the application to these wirings of the positive voltage V that is supplied through the diodes 18 and 19 connected to the first wiring $A_1$ when the PNP transistor $11_1$ is rendered on. The seventeenth, thirty-third, . . , and two hundred and forty-first wirings $A_{17}, A_{33}, \ldots$ , and $A_{241}$ are kept substantially at the positive voltage V because the points of connection of the first diodes 18 to the first conductor 16 are supplied with the positive voltage V when the PNP transistor $11_1$ is rendered on and because the first diodes 18 will prevent the application to these wirings of ground that is supplied to the first wiring $A_1$ when the NPN transistor $12_1$ is rendered on. The remaining wirings, such as the two hundred and fifty-sixth wiring $A_{256}$, are supplied with no definite electric potential. A wiring, such as $A_1$, which is coupled to a matrix point connected to a pair of PNP and NPN transistors which are rendered alternatingly on is supplied with the pulse voltage V while the remaining wirings, such as $A_2$, $A_{17}$, and $A_{256}$, are supplied with no pulse voltage. It is therefore possible with the circuit illustrated to cyclically supply a pulsed voltage V to one electrode group of the plasma display panel 10 and to make the panel 10 display one or more desired numerals, letters, and/or the like by selectively supplying the opposed electrode group with a pulse voltage of the reversed polarity in timed relation to the pulse voltage V.

In connection with the above-mentioned operation of the driving circuit, it is necessary to take the following three points into consideration. First, it is necessary in order to provide a flickerless display by means of a time division drive to refresh each electrode of the group concerned with a voltage pulse train having a frequency of the order of 50 Hz or more. The repetition frequency of the clock pulses should therefore be 12.8 kHz (50 Hz × 256) or more. Second it is necessary in order to provide a sufficiently bright display to supply each electrode of the relevant group with two thousand or more pulses during each second. The repetition frequency of the pulse train $\phi_1$ or $\phi_2$ should therefore be approximately 500 kHz (2 kHz × 256) or more. It has been confirmed that the embodiment illustrated in FIG. 1 has a switching time of 0.2 microsecond or less for the pulses supplied to the panel electrodes and is stably operable at frequencies as high as 700 kHz.

Third the pulsed voltage or voltages supplied to one or more electrodes of a gas discharge display panel will induce unwanted electric currents in adjacent electrodes through electrostatic induction or coupling between the electrodes. This will give rise to a spurious display particularly at those electrodes connected to the wirings to which no definite potential is being supplied. The capacitors 39 are utilized to ground the wirings A for high-frequency signals and thereby limit this unwanted effect. The capacitors 39, however, should not have large capacities because a large-capacity capacitor will adversely affects the leading edges of the voltage pulse train which is supplied to a wiring, such as $A_1$, since the wiring in turn is connected to the capacitor in question. It has been confirmed that the capacity of each of the capacitors 39 should be chosen between 10 and 50 pF when the total interelectrode capacity of a gas discharge display panel is about 7 pF. With capacitances of this order, may be substituted for some or all of the first or second diodes 18 or 19.

Figure 2:
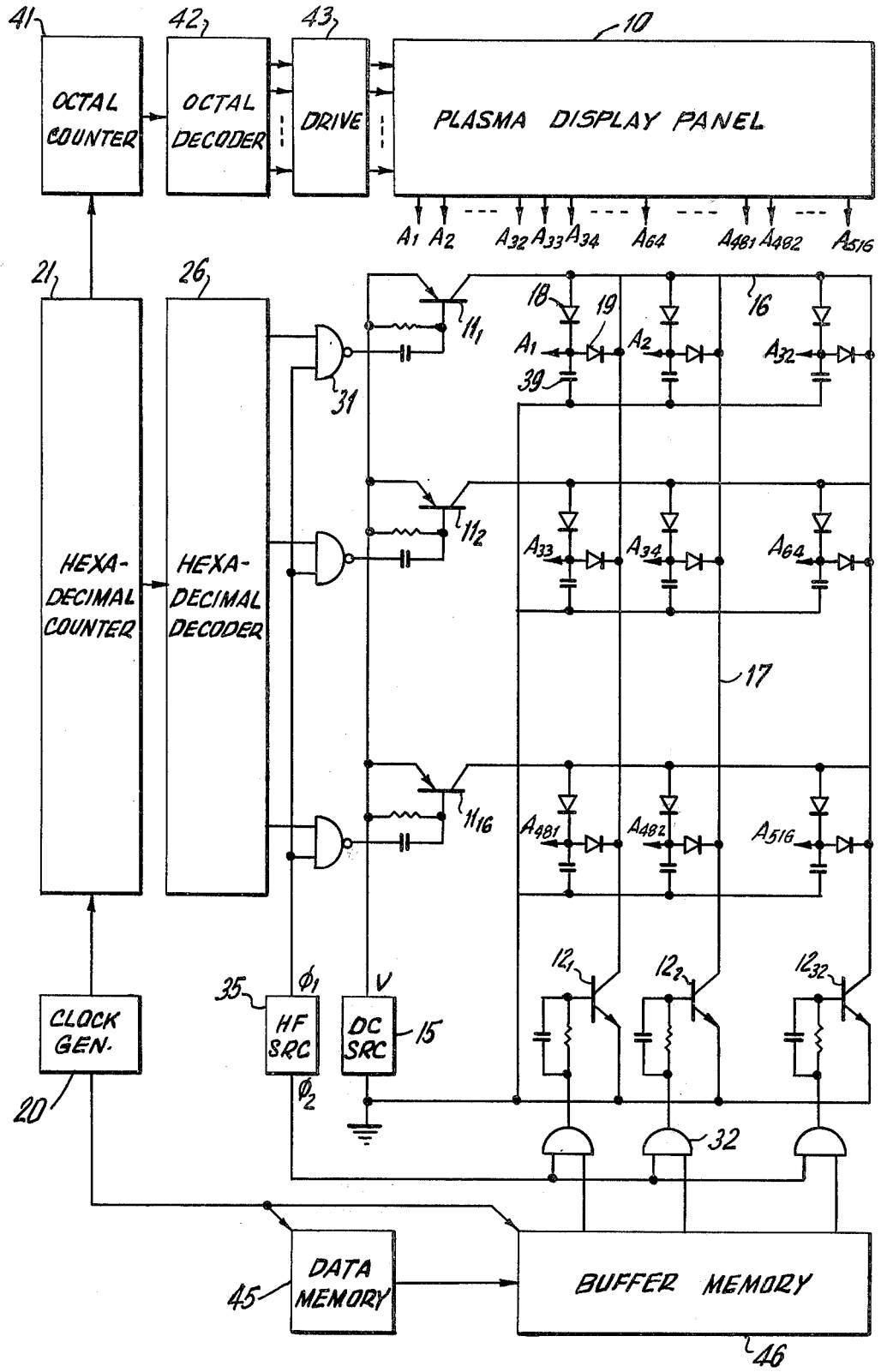
FIG. 2 similarly shows a driving circuit partially on block diagram according to a second embodiment of this invention.

Referring to FIG. 2, a circuit is shown according to a second embodiment of this invention for driving 512 column electrodes of a plasma display panel 10 having matrix electrodes. Similar elements or parts, of the embodiment of FIG. 2 are designated by like reference numerals and letters as in FIG. 1. It is surmised here that the panel 10 has eight row electrodes drives in a time division fashion and that the column electrodes are divided into sixteen groups, each consisting of thirty-two electrodes which should selectively be supplied with one or more pulse trains. In circuit shown in FIG. 2 an octal counter 41 is substituted for the second hexadecimal counter 22, of the circuit of FIG. 1. An octal decoder 42 is supplied with the three-bit signal outputs of the octal counter 41. A group of driver circuits 43, which may be conventional circuits of this type generate outputs to drive the row electrodes in a time division fashion in response to the output signal produced by the octal decoder 42. The output of decoder 42 appears on its eight output terminals cyclically. The circuit further comprises a data memory 45 in which 32-bit binary signals representative of the numerals, letters, and/or the like to be displayed are preliminarily stored either manually or otherwise. A second pulse train is supplied from the clock generator 20 to drive the data memory 45. The memory 45 supplies a 32-bit signal to a buffer memory 46 each time the output of the hexadecimal decoder 26 shifts from one terminal to the next subsequent terminal. Other than the differences set forth above the circuit of FIG. 2 operates in a manner similar to that of FIG. 1.

Figure 3:
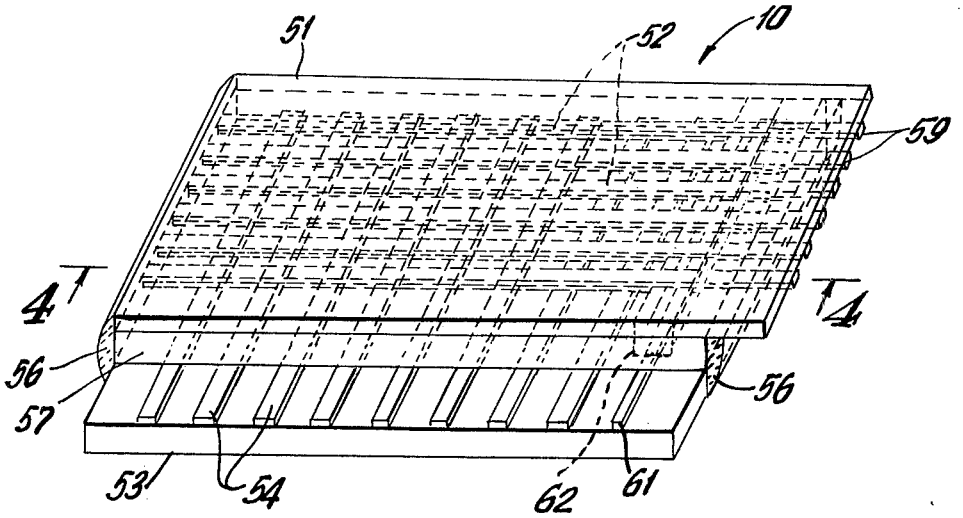
FIG. 3 is a schematic perspective view of an external electrode gas discharge display panel including capacitor means used in a driving circuit according to this invention.
Figure 4:
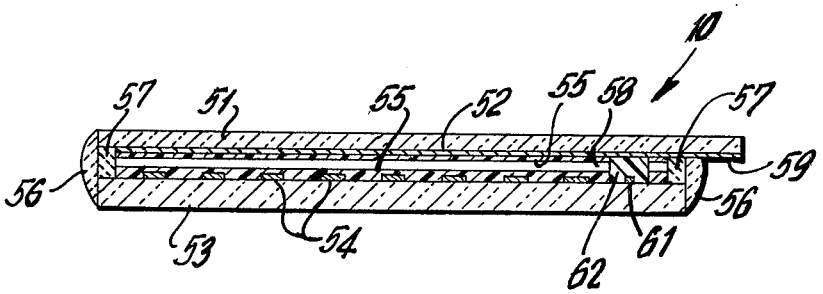
FIG. 4 is a schematic cross-sectional view of the gas discharge display panel, taken on a plane indicated in FIG. 3 by a line 4—4.
Figure 5:
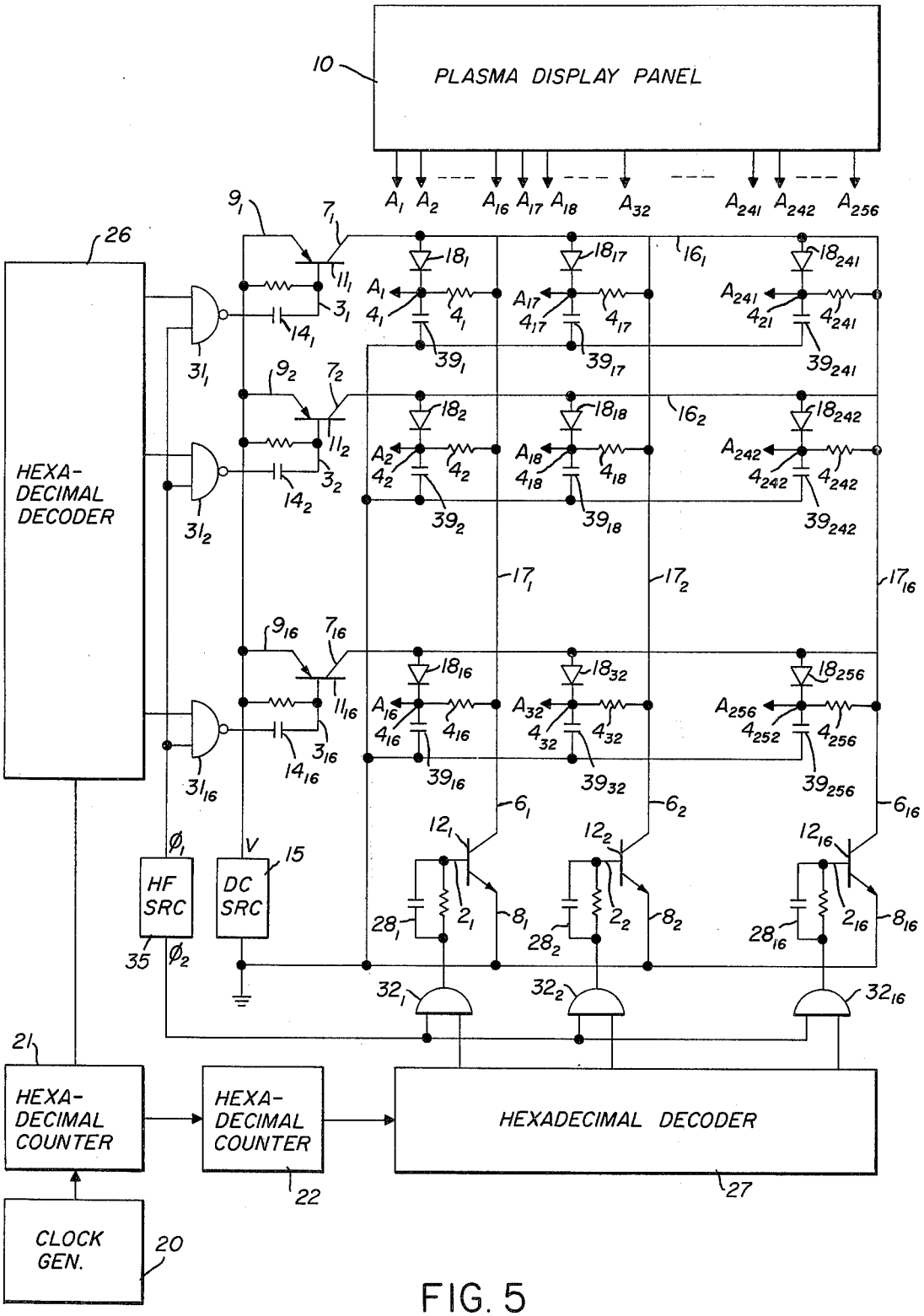
FIG. 5 shows, partly in block diagram, a driving circuit according to a third embodiment of the instant invention.

Referring now to FIGS. 3 and 4, the capacitors 39 of FIGS. 1 and 2 may conveniently be provided within a gas discharge display panel. In the example illustrated, a matrix electrode plasma display panel 10 comprises a first base plate 51 on which a plurality of parallel silver electrodes 52 are disposed. A second, transparent base plate 53 has a plurality of parallel transparent electrodes 54 thereon which are oriented transversely to electrodes 52. The electrodes 52 and 54 are covered by layers 55 of a dielectric material. The first and second base plates 51 and 53 are sealed together by sealing glass 56 and a spacer 57 is interposed between the plates 51 and 53 to leave a predetermined space. The space between plates 51 and 53 is evacuated and thereafter filled with an ionizable gas to provide a discharge space 58. Conductors, such as 59, extend on the plates 51 and 53 outwardly from the discharge space 58 through the spacer 57 and seal 56. The display panel 10 further includes an additional electrode 61 formed on one of the base plates either 51 and 53 and oriented transversely to the electrodes disposed on the other base plate. In the example shown in FIG. 3 this additional electrode 61 is formed on base plate 53 parallel to electrodes 54 and transverse to electrodes 52. A block 62 of a dielectric material is attached along the additional electrode 61 on the base plate 53 and extends across space between the plates to the electrodes on the other base plate 51 when the base plates 51 and 53 are sealed together as described. When the additional electrode 61 is connected to a point of a substantially constant voltage, a plurality of capacitors 39 will be formed between the conductors, 59 formed on plate 51, and points along the constant voltage electrode 61. Conductors 59 are connected to wirings such as $A_1$ and thereby to the driver circuits of FIGS. 1 and 2. The display panel 10 may include another set of similarly formed capacitors when the circuitry according to this invention is used to drive both electrode groups. The additional electrode, such as 61, may be attached to either of the base plates 51 or 53 at an area outside the discharge space 58.

What is claimed is:

1. A circuit for driving a first electrode group of a gas discharge display panel having a first and a second electrode group arranged on either side of a gas discharge space including:

a first plurality of PNP transistors, each having an emitter and a collector electrode;

a second plurality of NPN transistors, each having an emitter and a collector electrode;

first means for applying a positive voltage to the emitter electrodes of said PNP transistors;

second means for applying a reference potential to the emitter electrodes of said NPN transistors;

a first plurality of conductors, connected to the collector electrodes of said PNP transistors;

a second plurality of conductors, connected to the collector electrodes of said NPN transistors, each of said second conductors intersecting all of said first plurality of conductors to form a plurality of matrix points;

a plurality of forwardly directed diode means one of which is connected between said first and second conductors across each of said matrix points;

connecting means for connecting individual ones of said diode means to the respective electrodes of said one electrode group; and a capacitor means connected between individual ones of said diode means at each of said matrix points and a point of a substantially constant voltage.

2. A circuit as claimed in claim 1, wherein each of said diode means includes first and second diodes, said first diode having its cathode connected to one of said second conductors and its anode connected to the cathode of said second diode at a junction point and the anode of said second diode being connected to one of said first conductors, the respective electrodes of said one electrode array being connected to the junction points formed by said first and second diodes, and said capacitance means being connected between said junction points and said point of substantially constant voltage.

3. A circuit as claimed in claim 1 wherein each of said diode means includes a diode and a resistor said diode being connected in a forward direction between one of the conductors intersecting to form one of said matrix points and one terminal of said resistor at a junction point and the other terminal of the resistor being connected to the other of the conductors intersecting to form the said one matrix point.

4. A circuit as claimed in claim 1 wherein the capacitance of said capacitor means is between 20 and 50 pf.

5. A circuit as claimed in claim 1 wherein said capacitance means includes an additional electrode arranged substantially parallel to the electrodes forming said second electrode group and substantially transverse to the electrodes forming said first electrode group, means to apply a source of substantially constant voltage to said additional electrode and dielectric means disposed between said additional electrode and the electrodes forming said first electrode group.

6. A circuit for driving a first group of electrodes of a gas discharge display panel which panel includes first and second opposed spaced base plates, said first group of electrodes being formed on said first base plate so that at least portions of said first group of electrodes are parallel to one another, said circuit including:

a first plurality of PNP transistors, each having an emitter and a collector electrode;

a second plurality of NPN transistors, each having an emitter and a collector electrode;

first means for applying a positive voltage to the emitter electrodes of said PNP transistors;

second means for applying a reference potential to the emitter electrodes of said NPN transistors;

a first plurality of conductors, connected to the collector electrodes of said PNP transistors;

a second plurality of conductors, connected to the collector electrodes of said NPN transistors, each of said second conductors intersecting all of said first plurality of conductors to form a plurality of matrix points;

a plurality of forwardly directed diode means one of which is connected between said first and second conductors across each of said matrix points;

connecting means for connecting individual ones of said diode means to the respective electrodes of said first group of electrodes; and a capacitor means including an additional electrode formed on said second base plate substantially transverse to said parallel portions of said first group of electrodes;

means to apply a substantially constant voltage to said additional electrode; and dielectric means disposed between said additional electrode and said first group of electrodes.

7. A circuit as claimed in claim 6 wherein said dielectric means includes a block of dielectric material extending along said additional electrode and extending outwardly from said second base plate toward said first group of electrodes formed on said first base plate.

8. A gas discharge display panel including first and second substantially parallel opposed base plates;

a first group of electrodes formed on said first base plate;

a second group of electrodes formed on said second base plate, in a direction substantially transversely to said first group of electrodes;

an additional electrode formed on said second base plate in a direction substantially transverse to said first group of electrodes;

first dielectric means disposed between said first and second group of electrodes; and second dielectric means including a block of dielectric material extending along said additional electrode and extending outwardly from said additional electrode to said first group of electrodes.

9. A gas discharge display panel as claimed in claim 8 in which said second dielectric means provides an electrostatic capacity between said additional electrode and said first group of electrodes, which is greater than the total interelectrode capacity between said first and second groups of elctrodes provided by said first dielectric means.

* * * * *